US005081328A

United States Patent [19]

Friend et al.

[11] Patent Number: 5,081,328

[45] Date of Patent: Jan. 14, 1992

[54] FLOW SWITCH

[75] Inventors: Alden E. Friend, Valencia; Darrell J. Christy, Chatsworth, both of Calif.

[73] Assignee: ITT Corporation, New York, N.Y.

[21] Appl. No.: 461,196

[22] Filed: Jan. 5, 1990

[51] Int. Cl.[5] ..... H01H 35/24; H01H 35/40

[52] U.S. Cl. ..... 200/81.9 R; 200/83 A

[58] Field of Search ..... 200/81.9 R, 81.9 M, 200/83 P, 38 A, 83 R

[56] References Cited

U.S. PATENT DOCUMENTS 2,719,889 10/1955 Miller ..... 220/81.9 R
3,226,505 12/1965 Lucas et al. ..... 200/81.9 R
3,510,616 5/1970 DiNoia et al. ..... 200/81.9 R
3,999,910 11/1976 Russell et al. ..... 200/83 A
4,242,082 12/1980 Bransom et al. ..... 200/83 A X
4,455,094 6/1984 Russell ..... 200/81.8 X

*Primary Examiner*—J. R. Scott
*Attorney, Agent, or Firm*—Menotti J. Lombardi

[57] ABSTRACT

A flow switch with a pressure sensing negative rate membrane. The membrane is designed for integral operation with a venturi element and an actuator. The membrane is a snap action device which, when a differential pressure is sensed, deflects from one position to another to operate the actuator.

4 Claims, 2 Drawing Sheets

FLOW SWITCH

BACKGROUND OF THE INVENTION

This invention relates to flow switches and more particularly to a flow switch having a pressure sensing negative membrane.

In accordance with the prior art, a multiple piece construction design is used to sense and convert fluid pressure into mechanical action. Such an arrangement includes a diaphragm, a belleville spring, a mechanical pressure plate actuator, an O-ring seal and a retainer to contain the diaphragm seal. This type flow switch (Series 158F) is available from ITT Neo-Dyn (Chatsworth, Cal.). The differential pressure is generated by flowing fluid or air through a calibrated orifice or a venturi. The flow and differential pressure unit, is designed to divide the high and low pressure by clamp sealing the diaphragm by means of an elastomer O-ring seal, using a bolted or threaded retainer.

As pressure is applied to the positive rate diaphragm it immediately begins to deflect and, as pressure is increased to the diaphragm, deflection increases directly proportional to the applied pressure, until it is supported by the pressure plate and belleville. From this point, the load is transmitted thru the diaphragm to the pressure plate and belleville spring. The operation of the prior art unit in sequence is as the differential pressure is applied to the diaphragm it in-turn transmits force to the belleville spring and pressure plate assembly.

The actuator of the pressure plate presses against the hinge-arm of a hermetic or pseudo hermetic electrical assembly, and the hinge-arm applies force to a microswitch plunger causing electrical circuit transfer, from normally closed to open circuit (on increasing pressure), and normally open to closed circuit (on decreasing pressure).

The motion required to convert fluid pressure to mechanical work, results in belleville spring bending, sliding, scraping and plowing friction at the inside (hole) diameter, and at the outside diameter of the belleville spring. The resultant friction increases hysteresis and causes an increase in the unit deadband. The deadband is the difference between actuation and deactuation, or it can be explained as the difference between the point of operation versus the point that it returns to its pre-operated state.

The limitations of the prior art design are overcome by the invention for a flow switch with singe piece design wherein direct pressure sensing is achieved through a negative rate membrane. No seals are required for the sensing membrane which rides on a fluid or air bearing. The invention provides high vibration and shock resistance due to low moving mass design and provides maximum sensing area for any given package size. The simplified construction reduces weight while increasing reliability and the number unit life cycles.

SUMMARY OF THE INVENTION

An object of the invention is to provide an improved flow switch.

Another object of the invention is to provide an improved pressure sensing negative rate membrane arrangement.

A feature of the invention is that the pressure sensing negative rate membrane is designed to operate integrally with the actuator.

Another feature of the invention is that the pressure sensing negative rate membrane is designed so that a fluid or air bearing surface exists at the periphery of the membrane.

According to the broader aspects of the invention, a pressure sensing negative rate membrane is positioned between a calibrated orifice or venturi element and an actuator means which is responsive to the snap action of the membrane, such that when a differential pressure is sensed by the membrane it activates the actuator means.

BRIEF DESCRIPTION OF THE DRAWINGS

Other objects, feature and advantages of the present invention will become more fully apparent from the following detailed description of the preferred embodiment, the appended claims and the accompany drawings in which:

DETAILED DESCRIPTION OF THE PREFERRED EMBODIMENT

Figure 1:
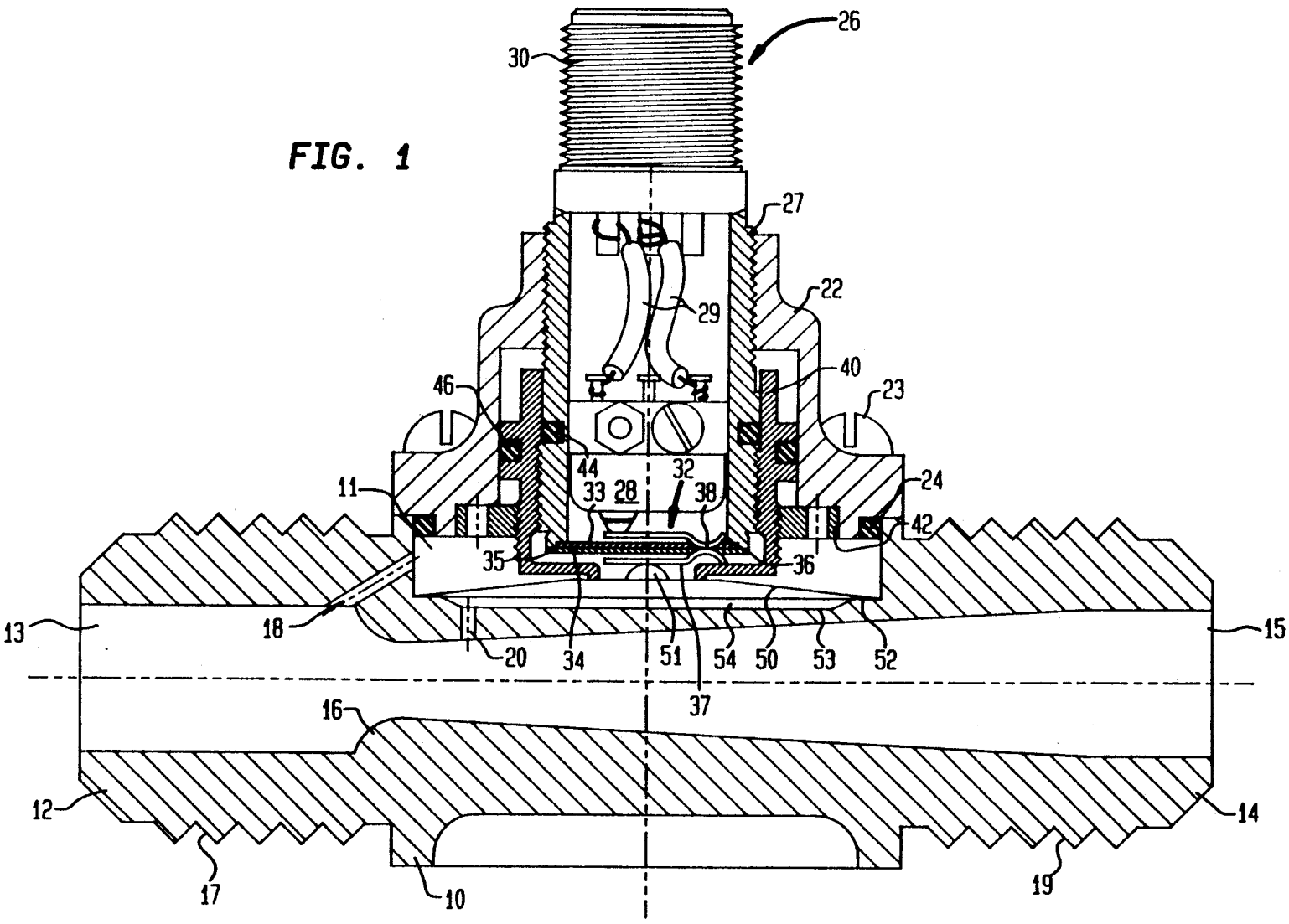
FIG. 1 is a section view illustrating the preferred embodiment of the invention.

Referring to FIG. 1, the calibrated orifice or venturi of the flow switch of the invention includes a port cap 10 having fluid input port 12 and a fluid output port 14. The cap 10 has a cavity 11, a restriction 16 with a high pressure passage 18, and a low pressure passage 20 located on either side of the restriction 16. A pressure differential is created which is dependent upon the flow rate of the fluid passing in the high pressure passage 13 and the flow rate of the fluid passing in the low pressure passage 15 in accordance with the known venturi principle. For mounting directly in a fluid line, ports 12,14 included exterior mounting threads 17,19.

A switch housing 22 is mounted to the port cap 10 by screws 23. An O-ring 24 for sealing purposes is located between housing 22 and cap 10. A hermetically sealed electrical assembly 26 is threaded in housing 22. The assembly 26 includes an electrical housing 27, a microswitch 28 which is connected by leads 29 to a connector 30, and an actuator arm assembly 32 positioned to be activated and actuate microswitch 28.

The known type actuator arm assembly 32 includes two stainless steel plates 33,34 with a stainless steel diaphragm 35 sandwiched therebetween and two motion transfer arms 36,37 spot-welded at point 38 to the diaphragm 35. An adjustable stop element 40 is threaded on housing 27 and retained by retaining ring 42 attached to housing 22. For sealing purposes, O-rings 44,46 are located on both sides of element 40.

A pressure sensing negative rate membrane (a snap action type diaphragm) 50 is free floating and positioned on a circumferential flat step 52 is formed on cap 10. The nipple portion 51 of the membrane 50 is positioned to move motion arm 37. A circular recess surface 53 is formed below step 52. The top of membrane 50 is exposed to the high pressure passage 20. A low pressure area 54 is provided between membrane 50 and cap 10 by means of low pressure passage 20. Element 40 adjusts the effective motion of membrane 50, and membrane 50 is free floating in that its peripheral diameter is less than the internal diameter of cavity 11.

Figure 2B:
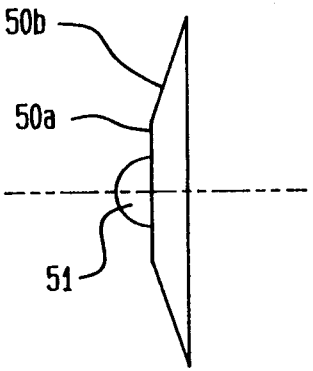
FIGS. 2*a* and 2*b* illustrate the pressure sensing negative rate membrane according to the invention.
Figure 2A:
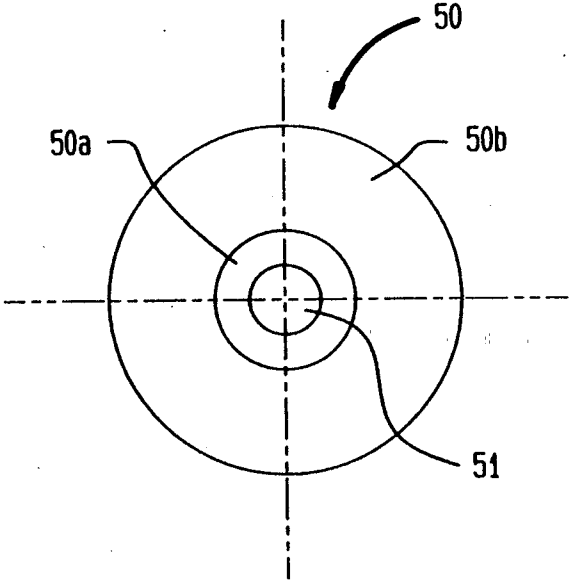

Referring to FIG. 2, the preferred embodiment of the membrane 50 according to the invention is illustrated. Membrane 50 includes a flat disc portion 50*a*, conical portion 50*b*, and a nipple 51. The nipple 51 extends from the flat disc portion 50*a*. The membrane 50 is preferably made from a 301 stainless steel, but could be fabricated from other materials such as beryllium copper, Inconel, etc., depending on service requirements. The disc thickness in the preferred embodiment is approximately 0.006 inches but could vary up to 0.025 inches depending on the flow rate and pressure drop.

In accordance with the foregoing description, the new pressure sensing negative rate membrane with integrally operated actuator, is designed to develop capture and store negative rate energy. As pressure is applied to the sensing membrane it resists motion until sufficient force is developed to overcome the stored negative rate energy. At this point of time, at pressure, the pressure sensing negative rate membrane deflects rapidly with a resultant snap action.

The pressure sensing negative rate membrane also incorporates an integral actuator that allows contact with and force distribution to the mechanical or electrical mechanism. This device allows transfer of fluid pressure into mechanical negative rate energy, as a stand alone device. The new pressure sensing negative rate membrane has one piece construction to sense fluid pressure and convert it to mechanical work.

The pressure sensing negative rate membrane is specifically designed by shape, thickness and size to generate negative rate energy necessary. The inventive configuration and construction of the pressure sensing negative rate membrane uses the least weight, and greatest effective area possible for any given size or package to convert fluid pressure to mechanical work and electromechanical energy.

In operation, the invention involves utilizing fluid or air bearings (depending on medium used) at the outside diameter of the pressure sensing negative rate membrane. The frictionless motion results in very narrow fluid or air pressure settings and resultant narrow deadband. This is due to the pressure sensing negative rate membrane with integral actuator not having a center hold that would induce friction, and to the incorporation of a fluid or air bearing surface at the outside of the membrane which eliminates sliding, scraping and plowing friction.

The switch of the invention is suitable for use in flow and differential monitoring, and for control of hydraulic systems, fuel systems and lube oil systems for aircraft and other airborne systems. Other uses for land and sea application are available in a variety of equipments for military, commercial, and industrial uses.

While the present invention has been disclosed in connection with a preferred embodiment thereof, it should be understood that there may be other embodiments which fall within the spirit and scope of the invention as defined by the following claims.

What is claimed is:

1. In combination:

a housing having a stepped circular switch cavity and a venturi passage transverse to said switch cavity, said venturi passage including a high pressure port, a restriction, and a low pressure port;

a disc shaped pressure sensing negative rate membrane floatably located on said step in said cavity;

a first orifice in said housing for connecting high pressure fluid from said high pressure port to one side of said membrane;

a second orifice in said housing on the low pressure side of said restriction for connecting low pressure fluid to the other side of said membrane;

said membrane being movable from a first position to a second position in response to a predetermined differential pressure existing between said high pressure fluid and said low pressure fluid in fluid communication with said one side and other side of said membrane, respectively; and switch means sealing mounted on said cavity and being responsive to the movement of said membrane to indicate movement of said membrane from said first position to said second position.

2. The combination of claim 1 wherein said membrane has a conical portion with a centrally located raised portion.

3. The combination of claim 2 wherein said switch means includes an activating arm member being mounted in said cavity to be activated by said raised portion, and an electrical switch member being mounted and positioned to be activated by said arm member.

4. The combination of claim 3 wherein said high and low pressure parts have external threads for mounting directly in a fluid line.

* * * * *